US010988955B1

(12) United States Patent
Castle et al.

(10) Patent No.: US 10,988,955 B1
(45) Date of Patent: Apr. 27, 2021

(54) PLAY TENT WITH INTERACTIVE AUDIO DEVICE

(71) Applicant: A&J Castle Enterprise Pty Ltd., Sydney (AU)

(72) Inventors: Jessica Castle, Sydney (AU); Andrew Castle, Sydney (AU)

(73) Assignee: A&J Castle Enterprise Pty Ltd., Sydney (AU)

( * ) Notice: Subject to any disclaimer, the term of this patent is extended or adjusted under 35 U.S.C. 154(b) by 0 days.

(21) Appl. No.: 17/140,090

(22) Filed: Jan. 3, 2021

Related U.S. Application Data

(63) Continuation-in-part of application No. 29/753,907, filed on Oct. 3, 2020.

(51) Int. Cl.

| | |
|---|---|
| ***A45F 5/02*** | (2006.01) |
| ***E04H 15/02*** | (2006.01) |
| ***A63H 33/00*** | (2006.01) |
| ***E04H 15/00*** | (2006.01) |
| ***A47D 15/00*** | (2006.01) |
| *H04R 1/02* | (2006.01) |
| *A45F 5/00* | (2006.01) |

(52) U.S. Cl.
CPC ..... *E04H 15/02* (2013.01); *A45F 5/022* (2013.01); *A47D 15/00* (2013.01); *A63H 33/008* (2013.01); *E04H 15/006* (2013.01); *A45F 2005/002* (2013.01); *H04R 1/025* (2013.01); *H04R 2201/021* (2013.01); *H04R 2201/023* (2013.01)

(58) Field of Classification Search
CPC ..... E04H 15/02; E04H 15/006; A63H 33/008; A45C 2013/303; A45F 5/022; A45F 5/14
USPC ..... 224/929
See application file for complete search history.

(56) References Cited

U.S. PATENT DOCUMENTS

| | | | | |
|---|---|---|---|---|
| D205,185 | S | 7/1966 | Ryan | |
| D206,487 | S | 12/1966 | Ryan | |
| 4,031,655 | A | 6/1977 | Ponciano et al. | |
| 4,046,295 | A * | 9/1977 | Eichler | A45F 5/02 224/242 |
| 4,322,585 | A * | 3/1982 | Liautaud | H04M 1/05 381/151 |

(Continued)

FOREIGN PATENT DOCUMENTS

| | | | | |
|---|---|---|---|---|
| CA | 2517414 A1 * | 5/2006 | | A45F 5/02 |
| CA | 2517414 A1 | 5/2006 | | |

(Continued)

OTHER PUBLICATIONS

Twinkle Play Tents, https://twinkleplaytents.com/, retrieved Aug. 31, 2020.

*Primary Examiner* — Robert Canfield
(74) *Attorney, Agent, or Firm* — The Roy Gross Law Firm, LLC; Roy Gross

(57) ABSTRACT

A play tent including a floor having a top surface and a bottom surface, the top surface is positioned inside the play tent, and one or more sidewalls extending from the floor. The play tent further includes an audio device with an actuator configured to turn the audio device on and off from inside of the play tent, and a coupling member that removably couples the audio device to the top surface of the floor. The coupling member has a pocket that houses the audio device and an attachment device that removably couples the pocket to the top surface of the floor.

18 Claims, 8 Drawing Sheets

(56) References Cited

U.S. PATENT DOCUMENTS 4,556,391 A * 12/1985 Tardivel ..... A63H 33/00 135/125
4,589,134 A * 5/1986 Waldron ..... H04R 5/02 381/301
4,620,653 A * 11/1986 Farrell ..... A41F 9/002 224/219
4,764,962 A * 8/1988 Ekman ..... H04R 1/02 224/259
4,775,083 A * 10/1988 Burger ..... A45F 5/02 224/240
4,858,798 A * 8/1989 Siddoway ..... A45F 5/02 224/242
5,121,865 A * 6/1992 Howard ..... A45F 5/00 224/240
5,525,088 A * 6/1996 Mayne ..... A63F 3/00895 206/457
5,544,870 A 8/1996 Kelley et al.
D374,259 S 10/1996 Hsu
5,598,926 A * 2/1997 Vogt ..... A44C 1/00 206/37
D446,554 S 8/2001 Gautieri et al.
6,319,087 B1 * 11/2001 Ferrigno ..... A63H 5/00 206/758
6,695,187 B1 * 2/2004 Dunkle ..... A45F 3/04 224/601
6,722,084 B2 * 4/2004 Berman ..... E04H 15/006 135/120.1
D495,756 S 9/2004 Carley et al.
D508,092 S 8/2005 Williams-Nicholas
7,031,147 B2 4/2006 Zheng
D525,318 S 7/2006 Campbell et al.
D527,055 S 8/2006 Hester
D579,986 S 11/2008 Walsh
D604,369 S 11/2009 Walsh
D606,595 S 12/2009 Levy et al.
D607,517 S 1/2010 Walsh
7,976,396 B2 7/2011 Boretskin
D737,381 S 8/2015 Putnam et al.
9,155,974 B2 10/2015 Fair et al.
9,264,791 B1 * 2/2016 Pol ivy ..... H04R 1/025
9,714,508 B2 7/2017 Israel et al.
2001/0038522 A1 * 11/2001 Zheng ..... G06F 3/0221 312/223.2
2002/0162584 A1 11/2002 Berman
2003/0019766 A1 * 1/2003 Jung ..... A63B 57/0032 206/38
2008/0190471 A1 * 8/2008 Tarter ..... E04H 15/10 135/96
2009/0230001 A1 * 9/2009 George ..... A45F 5/022 206/37
2012/0106764 A1 * 5/2012 Burns ..... H04R 1/1033 381/334
2012/0289123 A1 11/2012 Zheng
2013/0331153 A1 * 12/2013 Krimstock ..... H04M 1/05 455/569.1
2014/0174845 A1 6/2014 Slotznick
2016/0360899 A1 * 12/2016 Neveling ..... G10K 11/16
2017/0042270 A1 * 2/2017 Chiang ..... A42B 1/241
2017/0358289 A1 12/2017 Israel et al.
2018/0279749 A1 * 10/2018 Quillmann ..... A43B 3/0031

FOREIGN PATENT DOCUMENTS

FR 2849752 A3 * 7/2004 ..... A45C 11/18
FR 2849752 A3 7/2004

* cited by examiner

PLAY TENT WITH INTERACTIVE AUDIO DEVICE

CROSS REFERENCE TO RELATED APPLICATIONS

This application claims priority to U.S. Ser. No. 29/753,907 filed Oct. 3, 2020. The contents of this application are hereby incorporated into this application their entirety.

FIELD OF THE INVENTION

The present invention relates to interactive playing devices. In particular, the present invention relates to an interactive audio device for use with play articles and/or play tents.

BACKGROUND OF THE INVENTION

Children's play tents have become very popular in the last few years. Play tents are great at encouraging role playing and developing kids' imagination. There is a wide variety of play tents available on the market currently with a variety of features.

For example, there are kids play tents with doorbells placed on the outside of the tent attached to the wall. The disadvantage of such play tents is that the bell is on the outside, while the kids play inside the tent, thus making the play tent less user friendly and enjoyable and not allowing for much interactive play.

There are also play tents with motion sensor activated lights placed inside the tent that play music, such as sold by Twinkle Play Tents. However, such play tents do not have an interactive sound device that the child can activate and have fun with while playing in the tent.

It is therefore desirable to provide an improved interactive audio device for play articles to make play articles more exciting and engaging for kids to stimulate kids' imagination and to encourage role playing and creativity. It is also desirable to provide an improved interactive audio device for play articles that is child-proof and safe for kids to play with while at the same time designed for easy access by adults when necessary.

SUMMARY OF THE INVENTION

In order to overcome the deficiencies of the prior art and to achieve at least some of the objects and advantages listed, the invention comprises a play tent and an audio device coupled to the play tent. The play tent includes a floor having a top surface and a bottom surface, wherein the top surface is positioned inside the play tent, and one or more sidewalls extending from the floor. The play tent also includes a coupling member that removably couples the audio device to the top surface of the floor. The coupling member comprises a pocket that houses the audio device and an attachment device that removably couples the pocket to the top surface of the floor. The audio device includes an actuator configured to turn the audio device on and off from inside of the play tent.

In certain embodiments, the pocket includes a top sheet and a bottom sheet each having four sides, wherein the top and bottom sheets are secured together along three of the sides to enclose an interior space of the pocket. In certain embodiments, the pocket includes an opening along a fourth side of the top and bottom sheets. In some of these embodiments, the interior space of the pocket is sized such that the audio device fits snuggly in the pocket. In other embodiments, the pocket includes an opening in the top sheet and at least a portion of the audio device extends out of the opening when the audio device is placed in the pocket. In additional embodiments, the attachment device includes a first attachment member coupled to the bottom sheet of the pocket and a second attachment member coupled to the top surface of the floor of the play tent.

In some embodiments, the attachment device comprises hook and loop fasteners (Velcro® strips). In additional embodiments, the attachment device comprises a loop and toggle combination.

In certain embodiments, the actuator includes a push button that is actuated by applying pressure to the push button.

In some cases, the play tent further includes an opening for access to the inside of the play tent.

In certain embodiments, the audio device is powered by a battery. In additional embodiments, the audio device is rechargeable or connected to a power source.

In certain embodiments, the one or more sidewalls includes at least one frame member and a fabric material coupled to the at least one frame member to enclose an interior space of the play tent. In some cases, the one or more sidewalls comprise a decorative pattern.

In certain embodiments, the device may have various shapes, such as a flower shape, hexagon shape, square shape, circular shape and/or other shapes.

In certain embodiments, the play tent includes a padded floor.

In certain embodiments, the play tent has a dinosaur print on the floor.

In certain embodiments, the pocket that houses the audio device is sewn into the padded floor.

In certain embodiments, the pocket includes a separate button that when pressed, turns on a light source that lights up the play tent. In certain embodiments, the light is a flashing light and/or includes starts.

In certain embodiments, play tent includes a light element within the play tent.

In certain embodiments, the light element is controlled by the audio device or by a separate button within the pocket that houses the audio device.

In certain embodiments, the play tent is a dinosaur themed play tent, such that the audio device emits a dinosaur roar and/or dinosaur sounds.

In certain embodiments, the play tent is a unicorn themed play tent, such that the audio device emits a unicorn neigh and/or unicorn related sounds.

In certain embodiments, the play tent is a jungle themed play tent, such that the audio device emits sounds related to animals such as a lion or elephant.

In certain embodiments, the play tent includes images on both the interior and exterior of the play tent, including the play tent floor and ceiling.

In certain embodiments, the play tent includes ventilation in the form of one or more screened in windows in the play tent.

In certain embodiments, the play tent includes multiple pockets for multiple audio devices.

Other objects of the invention are achieved by providing an interactive audio device for use with play articles. The device includes an outer housing, an actuator, a power source positioned inside the housing for powering the audio device, a sound emitting device positioned inside the housing, and a coupling member. The actuator turns the audio device on and off by applying pressure to the actuator. The coupling member includes a pocket that houses the audio device and an attachment device that removably couples the pocket to a play article.

In certain embodiments, the power source is a battery.

In some cases, the outer housing comprises a top portion and a bottom portion, wherein the bottom portion has a larger outer perimeter than the top portion.

In certain embodiments, the pocket comprises a top sheet and a bottom sheet each having four sides, wherein the top and bottom sheets are secured together along three of the sides to enclose an interior space of the pocket and wherein the pocket includes an opening along a fourth side of the top and bottom sheets. In some of these embodiments, the interior space of the pocket is sized such that the audio device fits snuggly in the pocket. In additional embodiments, the pocket has an opening in the top sheet and the top portion of the outer housing extends out of the opening when the audio device is placed in the pocket. In further embodiments, the size of the opening is larger than an outer perimeter of the top portion and smaller than an outer perimeter of the bottom portion such that the outer housing is securely retained in the pocket.

Other objects of the invention and its particular features and advantages will become more apparent from consideration of the following drawings and accompanying detailed description

DETAILED DESCRIPTION OF THE INVENTION

The goals and attributes of the invention, methods for achieving these goals and attributes will become evident by referencing proposed implementation variants. However, the invention is not limited to the proposed implementation variants detailed below, it can be implemented in various forms. The essence provided in the description just gives specific details necessary to help a technical specialist understand the invention completely, and the invention is defined within the scope of the appended patent claim.

Figure 1:
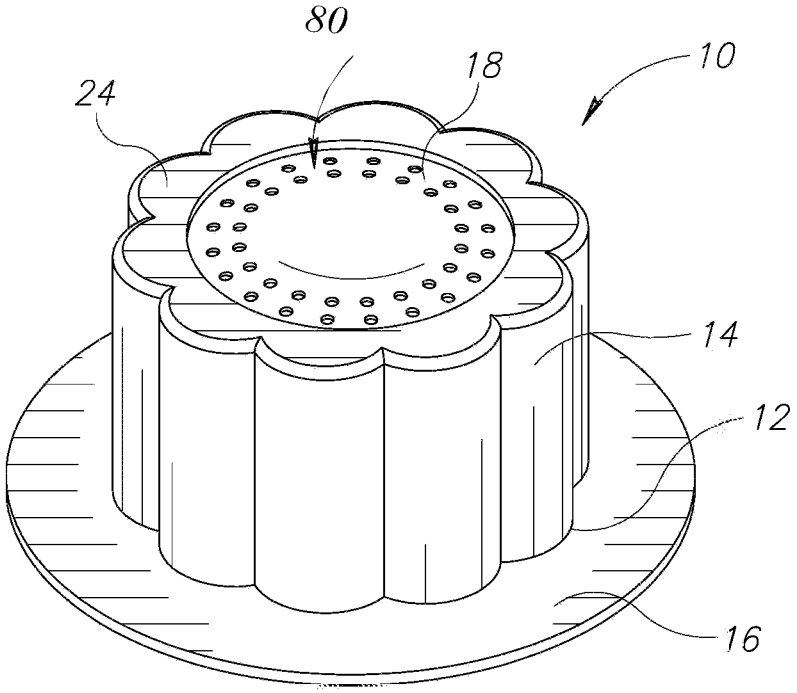
FIG. 1 is a top perspective view of the interactive audio device in accordance with the present invention.

One exemplary embodiment of the audio device of the present invention is shown in FIG. 1. The audio device can be used with any play articles, such as a play tent, etc., as discussed in more detail below. The audio device (10) includes an outer housing (12) made with any suitable material, such as, e.g., plastic, wood, metal, etc. The outer housing can have any desired shape, color and/or surface ornamentation. Preferably, the outer housing is made to match the scheme of the play article it is used with. In the embodiment shown in FIG. 1, the outer housing (12) is shaped like a flower. In other embodiments, the outer housing may have different shapes, such as hexagon or others.

Figure 2A:
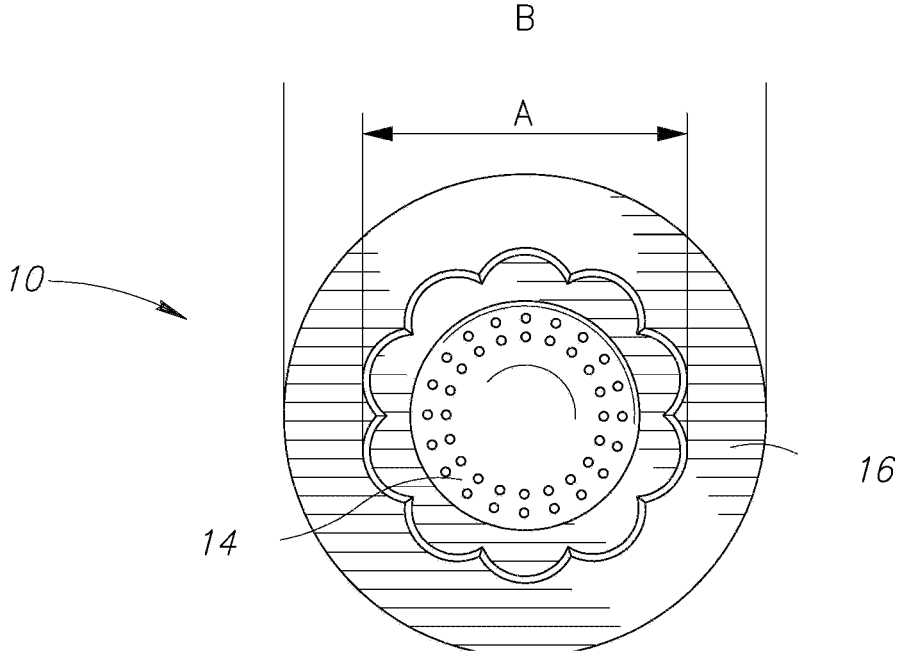
FIG. 2A is a top view of the interactive audio device of FIG. 1.

The outer housing (12) has a top portion (14) and a bottom portion (16). A shown in the top view in FIG. 2A, the top portion (14) has an outer perimeter (A) and the bottom portion has an outer perimeter (B). In a preferred embodiment, the outer perimeter (B) of the bottom portion is larger than the outer perimeter (A) of the top portion such that at least a portion of the bottom portion (16) extends out from the top portion (14). The top portion (14) of the outer housing (12) has a cylindrical shape extending upward from the bottom portion (16). The bottom portion (16) has a flatter circular shape. In one exemplary embodiment, a diameter or width of the top portion (14) is about 34 mm, a diameter or width of the bottom portion (16) is about 49 mm and a height of the entire outer housing (12) is about 21 mm. It is understood, however, that both the top and the bottom portions can have different shapes and sizes depending on a particular design of a play article or particular application.

Figure 2B:
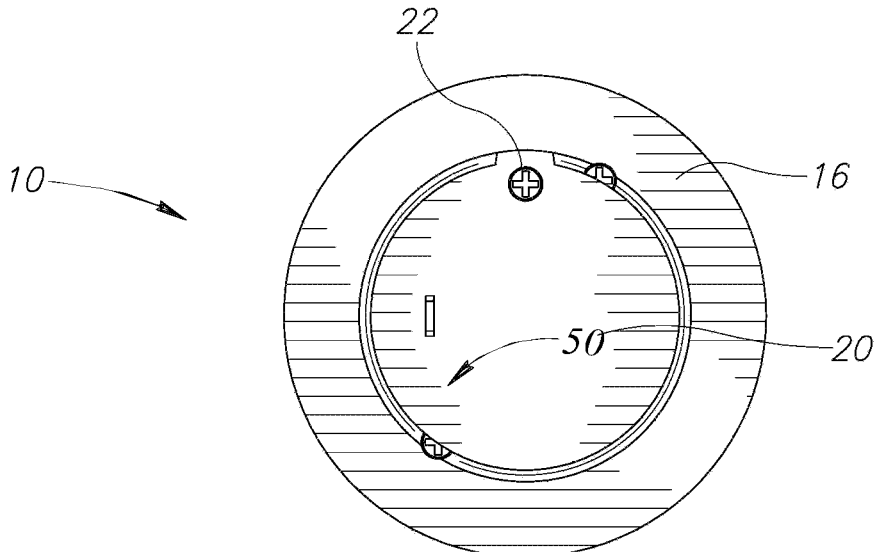
FIG. 2B is a bottom view of the interactive audio device of FIG. 1.

The outer housing (12) houses all other components of the audio device (10). There is a power source (not shown) positioned inside the outer housing (12) for powering the audio device. The power source can be one or more conventional batteries that are inserted into a socket inside the outer housing (12). As seen in the bottom view in FIG. 2B, the bottom of the outer housing has a removable closure (20), which can be accessed by a user to replace the batteries when necessary. The removable closure (20) is held in place by one or more screws (22) or by any other suitable closure means, such as a snap-connector, fit-connector, etc. It is understood that the removable closure can also be positioned on top or side of the outer housing (12). In other embodiments, the power source may be a rechargeable battery (50) positioned inside the outer housing (12). The rechargeable battery may be charged via a charging port positioned at any suitable location in the outer housing. The charging port may accommodate a USB port or another conventional charging port and can connect to an outlet or another source of electric power.

The outer housing (12) also houses a sound emitting device (80) positioned inside the housing. Any sound emitting devices known in the art may be used in accordance with the present invention. The outer housing (12) includes a plurality of openings (18) through which the sound emanates from the audio device. The plurality of openings may be positioned on top of the housing or at any other suitable location. In some embodiments, the sound emitting device (80) plays one or more pre-recorded sounds when actuated by a user. In other embodiments, the sound emitting device (80) is a speaker that is wirelessly connected to another audio device and can play any sounds from the audio device when actuated. The sounds can be music, animal sounds, nature sounds, words, songs, and/or any other desired sounds. In preferred embodiments, the sounds are selected to match the scheme of the play articles that the audio device is used with, e.g. a jungle scheme with jungle animal sounds.

The outer housing (12) also includes an actuator for turning the audio device on and off. In a preferred embodiment, the actuator (24) has a push-button mechanism that is actuated by applying pressure to the actuator by a user, such as by a child stepping on the top of the outer housing (12) or pushing the top of the outer housing (12) by hand. It is understood that, in additional embodiments, other suitable actuators known in the art may also be used, such as, e.g., a toggle switch, a voice activated control, a motion sensor actuator, and others. Once the audio device (10) is actuated, it will play sound(s) for a predetermined period of time and then automatically switch off. In alternative embodiments, the audio device (10) plays sound(s) until it is manually switched off by a user, either by activating the actuator again or by a remote control.

Figure 3:
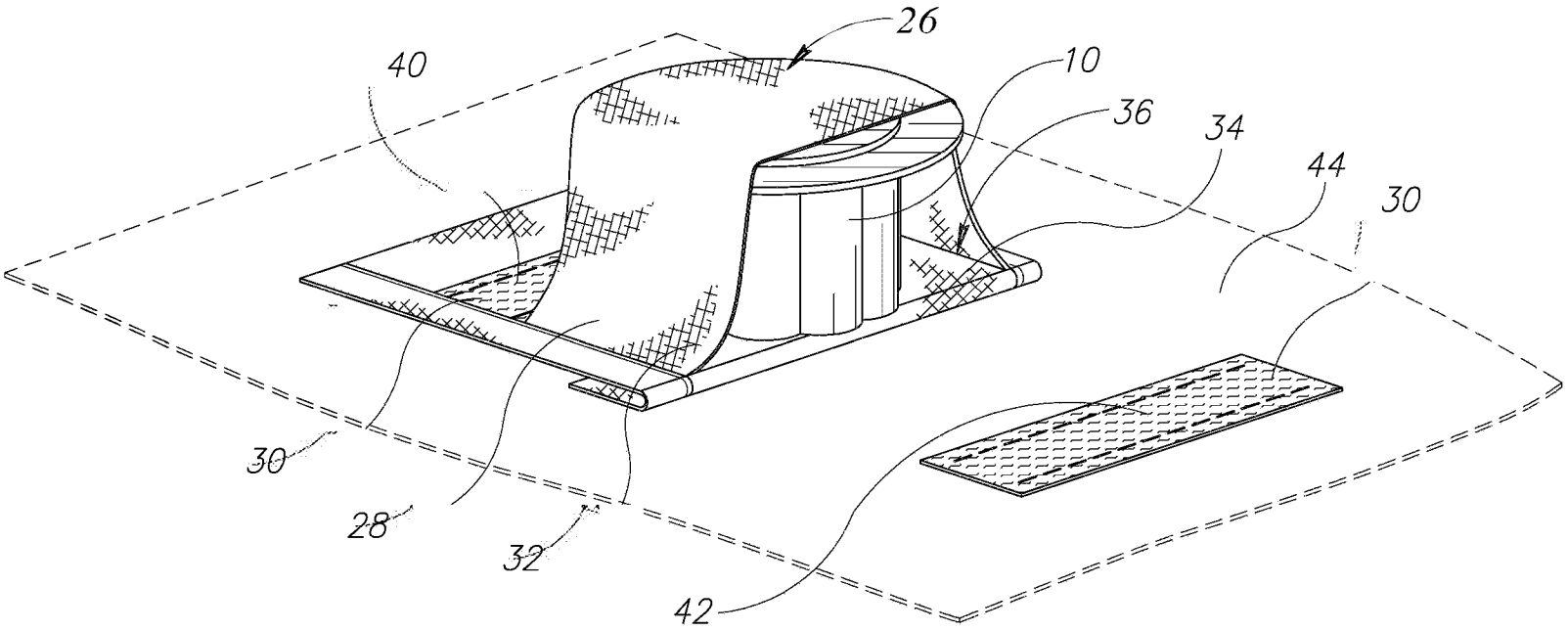
FIG. 3 is a top perspective view of the interactive audio device of FIG. 1 with a coupling member.

The audio device further includes a coupling member for attaching the audio device to a play article. As shown in FIG. 3, the coupling member (26) includes a pocket (28) that houses the audio device (10). The pocket (28) is made with any suitable material that is durable, inexpensive and suitable for children to handle, such as plastic or fabric. Some suitable examples of materials include nylon, polyester, cotton, linen, and such. The pocket includes a top sheet (32) and a bottom sheet (34) each having four sides. The top and bottom sheets (32, 34) are secured together along at least two of opposing sides to enclose an interior space of the pocket (28). In a preferred embodiment, the top and bottom sheets (32, 34) are secured together along three of the sides. The top and bottom sheets (32, 34) are secured together by any suitable means, such as stitching, using an adhesive, or welding. The pocket (28) has an opening (36) along a fourth side of the top and bottom sheets (32, 34), as shown in FIG. 3, so that the audio device (10) can be inserted into the pocket (28) though the opening.

Preferably, the interior space of the pocket (28) is sized such that the audio device (10) fits snuggly once inserted into the pocket. This ensures that the audio device (10) is secured within the pocket and will not fall out and be misplaced or mishandled by a child during play. Also, it makes it more difficult for a child to remove the audio device from the coupling member, which is undesirable.

Figure 5:
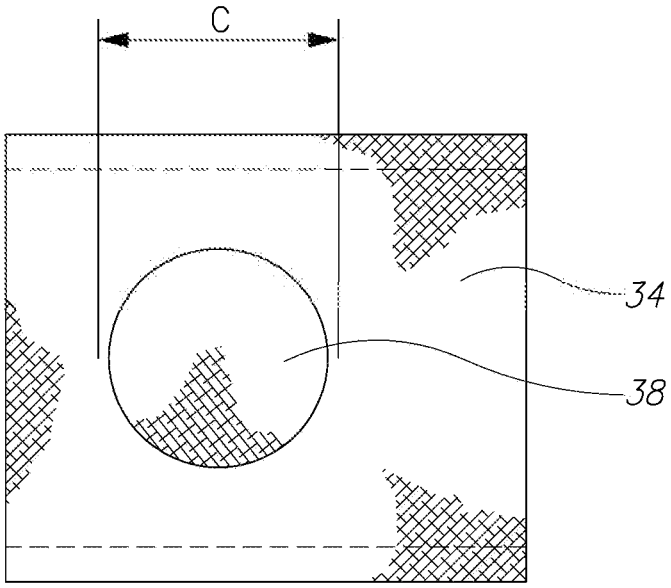
FIG. 5 is a top view of the coupling member of FIG. 3, without the interactive audio device.
Figure 6:
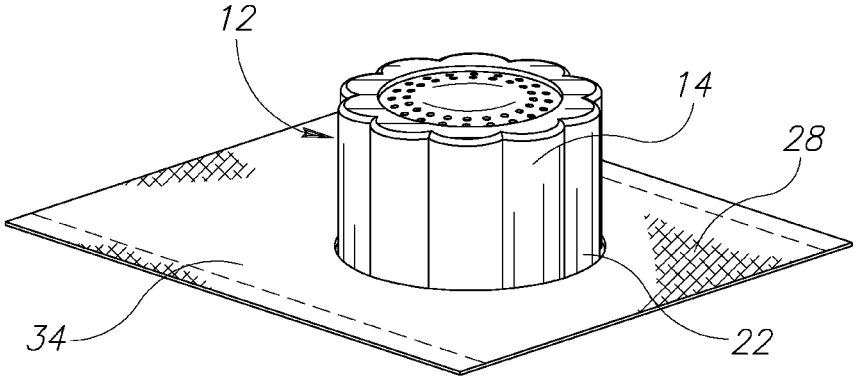
FIG. 6 is a top view of the coupling member of FIG. 5 with the interactive audio device positioned therein.

As seen in FIGS. 5 and 6, the pocket further includes an opening (38) in the bottom sheet (34). The opening (38) is sized and shaped to fit at least a portion of the top portion (14) of the audio device outer housing (12) such that the top portion (14) of the outer housing (12) extends out of the opening (38) when the audio device (10) is placed in the pocket (28), as shown in FIG. 6. Preferably, the size of the opening (C) is larger than the outer perimeter (A) of the top portion (32) and smaller than the outer perimeter (B) of the bottom portion (34). This way, the outer housing (12) is securely retained in the pocket (28), with the top portion (32) protruding through the opening (38) and the bottom portion securely retaining the audio device (10) within the pocket (38) such that it does not fall out from the opening (38) during use.

Figure 4A:
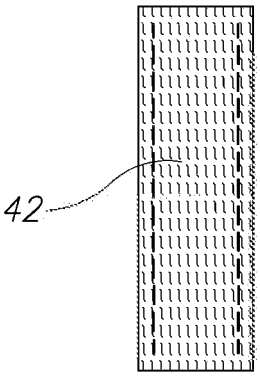
FIGS. 4A and 4B is an exploded bottom view of the coupling member of FIG. 3, without the interactive audio device folded over.
Figure 4B:
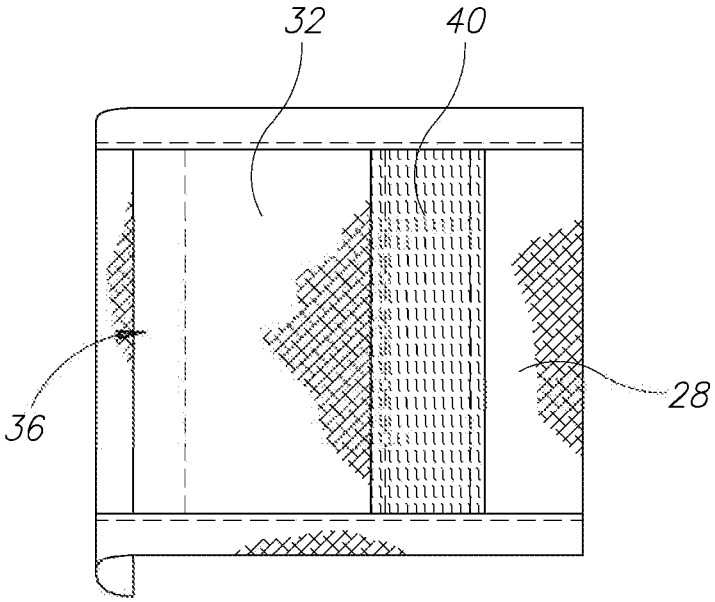

The coupling member (26) further includes an attachment device (30) that removably couples the pocket (28) to a play article. A shown in FIGS. 3 and 4, the attachment device (30) has a first attachment member (40) and a second attachment member (42). The first attachment member (40) is positioned on the top portion (32) of the pocket (28) on a side opposite to the opening (38). The second attachment member (42) is positioned on a play article to which the pocket (28) is being coupled to. In the exemplary embodiment shown, the first and second attachment members (40, 42) are mating hook and loop fasteners (Velcro®) strips. In other embodiments, the attachment members may be a loop and toggle combination or any other suitable attachment device. The first and second attachment members (40, 42) are secured to the pocket (28) and the play article respectively by any suitable means, such as stitching, adhesive or welding.

As illustrated in FIG. 3, the bottom sheet (34) of the pocket (28) is secured to the play article (44) (shown in phantom lines) along the side adjacent to the opening (36). The bottom sheet (34) is secured to the play article (44) by stitching or any other suitable method, e.g. adhesive or welding. Once the audio device (10) is positioned and secured within the pocket (28), as shown in FIG. 3, the pocket (28) is folded over such that the first attachment member (40) couples with the second attachment member (42) positioned on the play article (44) to releasably secure the audio device (10) to the play article. Once secured, the audio device in the pocket is in the position shown in FIG. 6, wherein the top portion (14) of the audio device outer housing (12) protrudes through the opening (38) in the pocket and can be seen and accessed by a child during play. In additional embodiments, the pocket (28) may be secured to the play article by releasable means, instead of stitching, etc., such that it can be entirely removed from the play article, if necessary, and used with a different play article or by itself.

Figure 7:
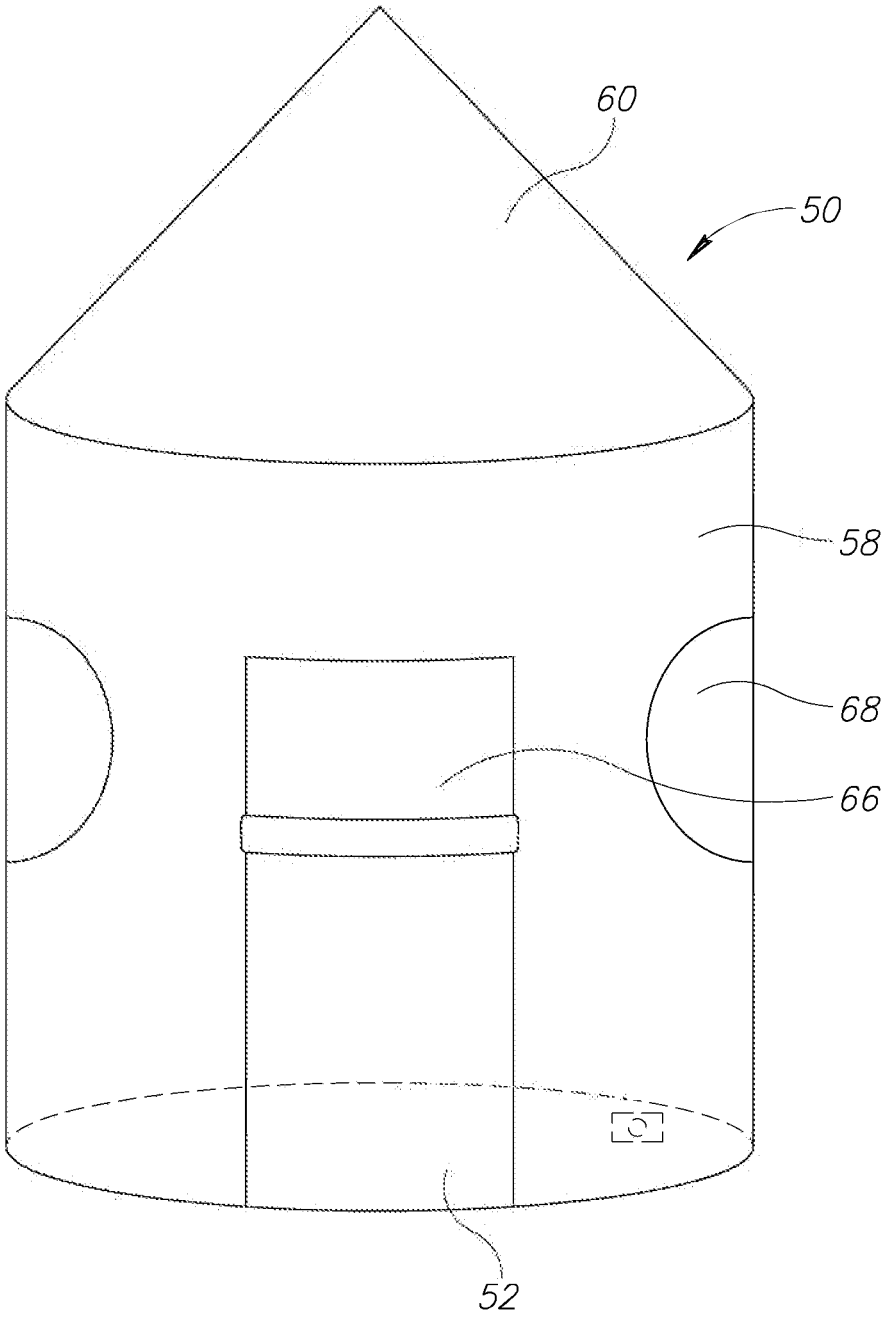
FIG. 7 is a perspective view of a play article with the interactive audio device of FIG. 1 placed therein.
Figure 8:
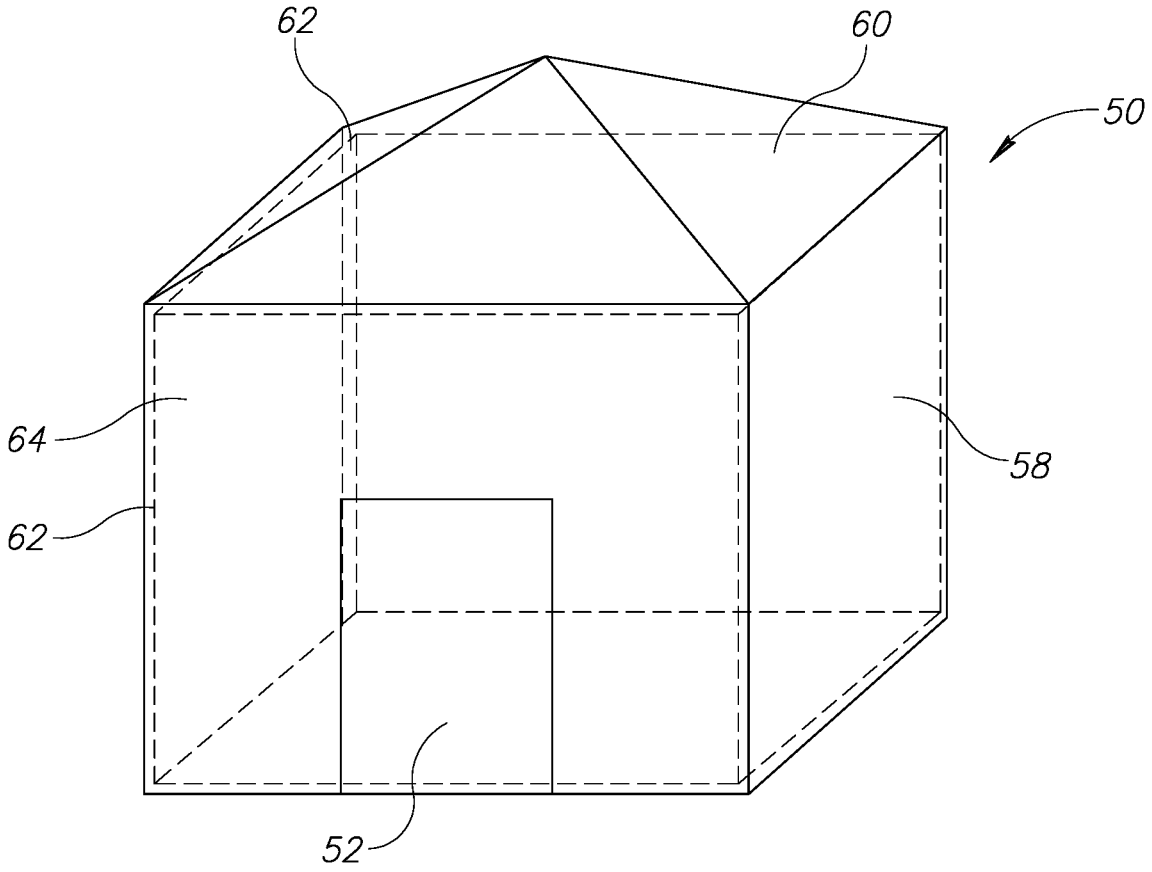
FIG. 8 is a perspective view of another play article with the interactive audio device of FIGS. 9A and 9B placed therein.

FIG. 7 illustrates a play article, in this case a play tent (50). The play tent (50) has a floor (52) and one or more sidewalls (58) extending from the floor. The sidewalls (58) include at least one frame member (62), as shown in phantom lines in FIG. 8, for providing a structural support for the play tent and a fabric material (64) coupled to the at least one frame member to enclose an interior space of the play tent. The frame members (62) are made with any suitable material. In one preferred embodiment, the frame members are made with fiberglass. In other embodiments, the frame members are made with metal, plastic, wood or another material. Any suitable fabric material can be used for the walls, such as nylon, polyester, cotton, linen, etc. The play tent (50) also has a top wall (60). Preferably, one or more side walls have a decorative pattern thereon, which can be produced by any suitable method, such as printing, etc. The side walls can have a decorative pattern on an outside surface, an inside surface or both.

The tent play tent (50) itself can have any desired size and shape. For example, in the embodiment shown in FIG. 7, the play tent has a cylindrical side wall, a circular floor and a conical top wall. In the embodiment shown in FIG. 8, the play tent (50) is in a shape of a house with four side walls. The play tent (50) also includes an opening (52) for access to the inside of the tent. The opening can have any size and shape and preferably has a closeable door (66) that can be opened and closed to provide privacy and access to the tent. In the embodiment shown in FIG. 7, the door (66) comprises a sheet of fabric that can be rolled up or down and secured in the rolled-up position by any suitable means, such as ties, hook and loop fasteners (Velcro® strips) or loop and toggle combination. Alternatively, the door may be rolled sideways, or may be a hinged or a sliding door, or any other suitable door mechanism. In some preferred embodiments, such as shown in FIG. 7, the sidewall (58) of the tent includes one or more window openings (68).

Figure 9A:
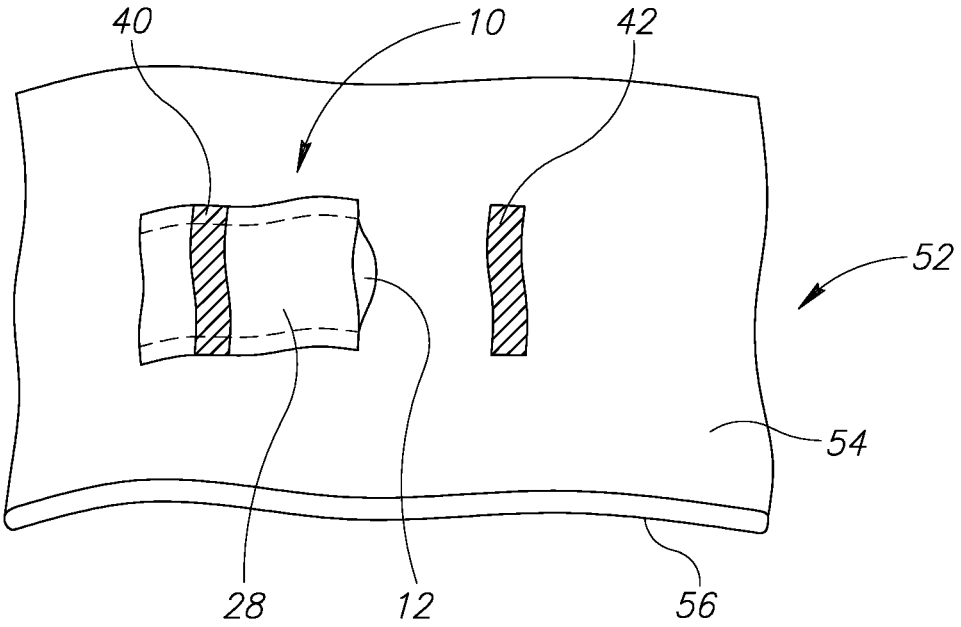
FIG. 9A is an enlarged view of a portion of the bottom of the play article of FIG. 8, showing the coupling device in an opened configuration.
Figure 9B:
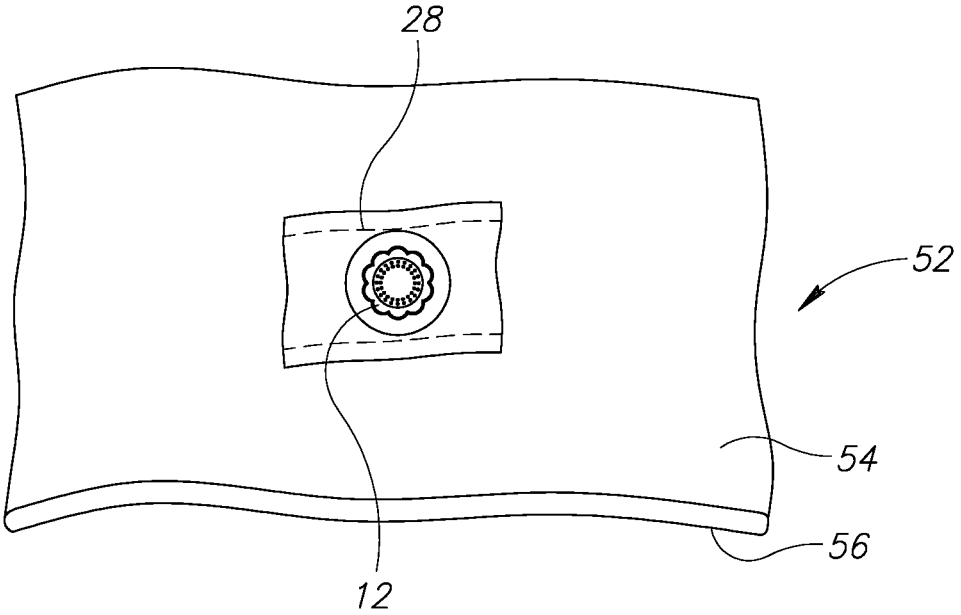
FIG. 9B is an enlarged view of a portion of the bottom of the play article of FIG. 8, showing the coupling device in a closed configuration.

As shown in FIGS. 9A-9B, the floor (52) of the play tent (50) has a top surface (54) and a bottom surface (56). The bottom surface (56) rests on the floor or another support surface and the top surface (54) is located inside the tent space. A padding layer may be provided between the top and bottom surfaces (54, 56) to make the tent more comfortable for play. The audio device (10) is positioned on the inside of the play tent (50) and is coupled to the top surface (54) of the floor (52) via the coupling device as described above. It is also understood that the audio device (10) may be coupled to a different portion of the play tent (50), e.g. to the sidewall or to the top wall.

After assembling the tent, the user places the outer housing of the audio device in the pocket (28) of the coupling member, as described above in connection with FIGS. 3-6. Once the audio device is securely positioned in the pocket (28), the pocket is flipped over and the first attachment member (40) on the pocket is coupled to the second attachment member (42) positioned on the top surface (54) of the floor (52) of the play tent, as shown in FIG. 9B. In this position, the top portion of the audio device protrudes through the opening in the pocket and is visible to and accessible by a child from the inside of the play tent. The child can turn the audio device on by pressing on the push-button actuator on the audio device to provide for an interactive playing experience. At the same time, the audio device is secured to the bottom of the play tent such that it cannot be easily removed from the play tent by the child and thus be lost or choked on. If necessary, the audio device can be removed from the pocket by adults if they want the play tent to be a place where there is no noise or if they need to change the battery or otherwise recharge the audio device. To do that, the first and second attachment members (40, 42) are uncoupled, the pocket (28) is flipped back to its position shown in FIG. 9A and the audio device housing (12) is accessed and removed through the opening in the pocket.

Examples provided in the description do not limit the scope of the invention defined by the patent claim. It will be clear to a specialist in this field that other implementations of the invention can exist that are consistent with the nature and scope of the invention.

What is claimed is:

1. A play tent, comprising:

a floor having a top surface and a bottom surface, wherein the top surface is positioned inside the play tent, one or more sidewalls extending from the floor, an audio device comprising an actuator configured to turn the audio device on and off from inside of the play tent, and a coupling member that removably couples the audio device to the top surface of the floor, wherein the coupling member comprises a pocket that houses the audio device and an attachment device that removably couples the pocket to the top surface of the floor.

2. The play tent according to claim 1, wherein the pocket comprises a top sheet and a bottom sheet each having four sides, wherein the top and bottom sheets are secured together along at least two of the four sides to enclose an interior space of the pocket and wherein the pocket includes an opening along a fourth side of the top and bottom sheets.

3. The play tent according to claim 2, wherein the interior space of the pocket is sized such that the audio device fits in the pocket.

4. The play tent according to claim 2, wherein the pocket comprises an opening in the bottom sheet and wherein at least a portion of the audio device extends out of the opening when the audio device is placed in the pocket.

5. The play tent according to claim 2, wherein the attachment device comprises a first attachment member coupled to the bottom sheet of the pocket and a second attachment member coupled to the top surface of the floor of the play tent.

6. The play tent according to claim 1, wherein the attachment device comprises hook and loop fasteners.

7. The play tent according to claim 1, wherein the attachment device comprises a loop and toggle combination.

8. The play tent according to claim 1, wherein the actuator comprises a push button that is actuated by applying pressure to the push button.

9. The play tent according to claim 1, further comprising an opening for access to the inside of the play tent.

10. The play tent according to claim 1, wherein the audio device is powered by a battery.

11. The play tent according to claim 1, wherein the audio device is rechargeable.

12. The play tent according to claim 1, wherein the one or more sidewalls comprise at least one frame member and a fabric material coupled to the at least one frame member to enclose an interior space of the play tent.

13. The play tent according to claim 1, wherein the one or more sidewalls comprise a decorative pattern.

14. An interactive audio device for use with play articles, comprising:

an outer housing, wherein the outer housing comprises a top portion and a bottom portion, wherein the bottom portion has a larger outer perimeter than the top portion, an actuator for turning the audio device on and off by applying pressure to the actuator, a power source positioned inside the housing for powering the audio device, a sound emitting device positioned inside the housing, and a coupling member comprising a pocket that houses the audio device and an attachment device that removably couples the pocket to a play article.

15. The interactive audio device according to claim 14, wherein the power source is a battery.

16. An interactive audio device for use with play articles, comprising:

an outer housing, an actuator for turning the audio device on and off by applying pressure to the actuator, a power source positioned inside the housing for powering the audio device, a sound emitting device positioned inside the housing, and a coupling member comprising a pocket that houses the audio device and an attachment device that removably couples the pocket to a play article, wherein the pocket comprises a top sheet and a bottom sheet each having four sides, wherein the top and bottom sheets are secured together along at least two of the sides to enclose an interior space of the pocket and wherein the pocket includes an opening along a fourth side of the top and bottom sheets, wherein the pocket comprises an opening in the bottom sheet and the top portion of the outer housing extends out of the opening when the audio device is placed in the pocket.

17. The interactive audio device according to claim 16, wherein the interior space of the pocket is sized such that the audio device fits in the pocket.

18. The interactive audio device according to claim 16, wherein the size of the opening is larger than an outer perimeter of the top portion and smaller than an outer perimeter of the bottom portion such that the outer housing is securely retained in the pocket.

* * * * *